United States Patent [19]

Swank

[11] 4,399,080

[45] Aug. 16, 1983

[54] HUMIDIFIER APPARATUS

[75] Inventor: Robert P. Swank, Mansfield, Ohio

[73] Assignee: Champion Spark Plug Company, Toledo, Ohio

[21] Appl. No.: 301,828

[22] Filed: Sep. 14, 1981

[51] Int. Cl.[3] ..... B01F 3/04

[52] U.S. Cl. ..... 261/80; 128/200.17; 128/200.18; 220/403; 220/404; 261/91; 312/31.2

[58] Field of Search ..... 261/29, 36 R, 80, 88–92, 261/78 A; 220/400, 403, 404; 128/200.17, 200.18; 312/31, 31.01, 31.2

[56] References Cited

U.S. PATENT DOCUMENTS

| | | | |
|---|---|---|---|
| 988,301 | 4/1911 | Bessonnet-Favre . | |
| 1,389,428 | 8/1921 | Gartling . | |
| 1,475,382 | 11/1923 | Gennevois . | |
| 1,763,395 | 6/1930 | Frederick . | |
| 1,919,777 | 7/1933 | Diehl . | |
| 2,076,192 | 4/1937 | Carr | 261/90 |
| 2,121,931 | 6/1938 | Sloan . | |
| 2,163,474 | 6/1939 | Sloan | 261/90 X |
| 2,335,598 | 11/1943 | Meldahl . | |
| 2,344,048 | 3/1944 | Marker et al. | 261/90 |
| 2,391,105 | 12/1945 | Reed . | |
| 2,554,868 | 5/1951 | Mills | 261/91 X |
| 2,912,702 | 11/1959 | Mackenzie | 220/404 X |
| 3,282,574 | 11/1966 | De Pas | 261/29 |
| 3,283,478 | 11/1966 | Katzman et al. | 261/91 X |
| 3,756,579 | 9/1973 | Remick | 261/92 |
| 3,787,036 | 1/1974 | Hastings | 261/92 X |
| 4,112,015 | 9/1978 | Tinsler | 261/92 |
| 4,222,971 | 9/1980 | Eilert | 261/92 |
| 4,267,928 | 5/1981 | Curry, Jr. | 220/403 X |

*Primary Examiner*—Richard L. Chiesa

*Attorney, Agent, or Firm*—Emch, Schaffer & Schaub Co.

[57] ABSTRACT

An improved humidifier having a permanant motor housing mounted above a reservoir. A disposable aerosol generator is releasably attached to the motor housing and the reservoir is lined with a disposable liner. The aerosol generator and liner are replaceable.

13 Claims, 11 Drawing Figures

HUMIDIFIER APPARATUS

BACKGROUND OF THE INVENTION

This invention relates to humidifiers and more particularly to an improved humidifier suitable for use in hospitals.

Humidifiers are commonly used in hospitals and homes for treatment of various respiratory conditions. When a humidifier is used in a hospital bacteria growth and contamination can develop in the humidifer and aggravate respiratory conditions in patients. Since room air normally is circulated through the humidifier for picking up water vapor and carrying such water vapor into the room the air passing through the humidifier becomes contaminated with the bacteria. The warm moist air in a humidifier is particularly suitable for growing bacteria. Usually after a humidifier has been used for several days the bacteria in the humidifier is at a level where the atomized air emitted from the humidifier contains a level of bacteria that is too high for hospital use. Consequently, the humidifier must either be sterilized or thrown away after each hospital use. Both sterilization and disposing of used humidifiers has been quite expensive. With rapidly increasing hospital costs, it is desirable to reduce costs wherever possible.

Two types of humidifiers are commonly used. In one type, water is boiled in a boiling chamber by passing an electric current between two electrodes submersed in the water. The resulting steam is directed into the room under its own force. In the other common type of humidifier, water is atomized by a spinning disc. As room air is passed through the humidifier the air picks up water vapor created by the spinning disc. The moistened air subsequently is discharged from the humidifier into the room. This design has certain safety advantages in that the water is never heated and there is no risk of burns in the event that a patient should contact the humidifier while it is operating. However, this humidifier design has been extremely difficult to sterilize. The humidifier typically comprises a motor driven disk from which water is centrifugally thrown to form small droplets. Fingers may be provided on the periphery of the disk to break up the water into small droplets or fixed fingers or slots may be spaced from the periphery of the disk for breaking the water into small droplets. These structures are difficult and expensive to sterilize.

SUMMARY OF THE INVENTION

The present invention is directed to a humidifier of the type in which room air is passed through an aerosol generator which forms small droplets of water. The humidified air then is returned to the room while excess water falls back into a reservoir. The humidifier has a base supporting a reservoir housing and mounting a housing which permanently mounts a motor for driving the aerosol generator. The aerosol generator is designed as a disposable unit which is releasably attached to the motor housing. The reservoir is designed to be used with a disposable liner. After a patient is finished using the humidifier, the aerosol generator and the liner for the reservoir are disposed of so that all humidifier surfaces exposed to airflow and wetted by aerosol are easily detached and disposable. The motor which drives the aerosol generator is enclosed within the main housing and is reused to greatly reduce the cost of the disposable components of the humidifier.

The aerosol generator includes a housing and a fan which draws room air through the housing and discharges the air back into the room. Water is pumped from a reservoir to the hub region of a rotating disk. The water is thrown from the disk by centrifugal force against a plurality of fixed impingment pins which are spaced from and around the periphery of the rotating disk. An endless belt pump lifts water from the reservoir to a trough which delivers the water to the hub region of the rotating disk. The belt pump preferrably comprises an endless resilient rubber O-ring which extends from a motor driven sheave over an idler wheel which is located within the reservoir below the liquid surface. As the belt is advanced by the driven sheave, surface tension causes the water to move upwardly from the liquid surface to the driven sheave where it is centrifugally discharged to the trough. The pump is inexpensive and works well over a wide range of liquid levels since it only is necessary for the belt to extend below the surface level.

Accordingly, it is an object of the invention to provide an improved humidifier for treating hospital patients.

Another object of the invention is to provide an improved humidifier of the type having an aerosol generator and in which portions of the humidifier which contact the aerosol are disposable.

Other objects and advantages of the invention will become apparent form the following detailed description.

DESCRIPTION OF THE PREFERRED EMBODIMENT

Figure 1:
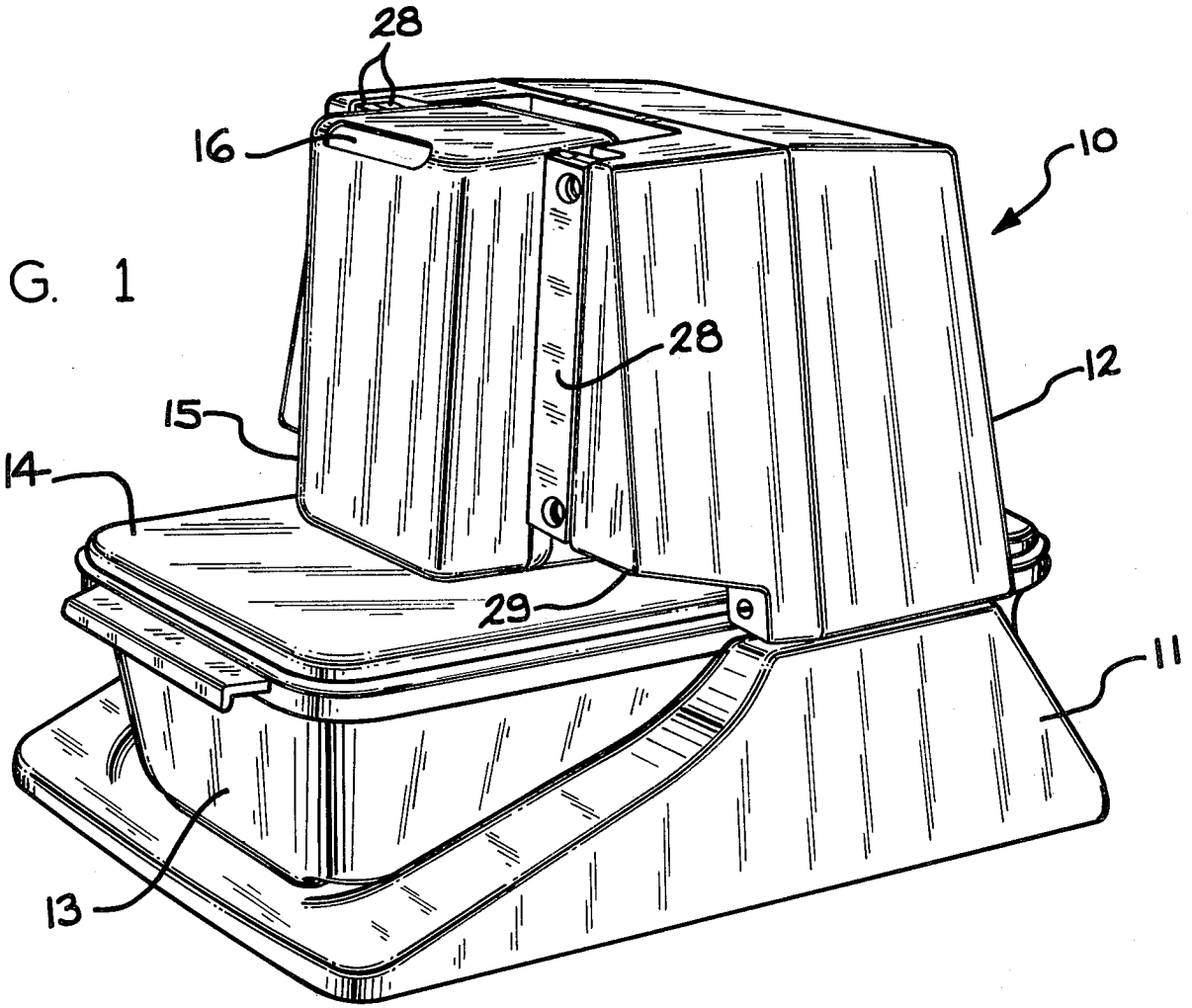
FIG. 1 is a perspective view of an improved humidifier constructed in accordance with the present invention.

Turning now to the drawings and particularly to FIG. 1, a humidifier 10 is illustrated in accordance with the present invention. The humidifier 10 generally comprises a base 11 to which a motor housing 12 is attached. A removable liquid reservoir consisting of a base 13 and a lid 14 rests on the humidifier base 11. An aerosol generator 15 is releasably attached to the motor housing 12 and extends through the reservoir lid 14 for generating an aerosol from liquid within the reservoir base 13. Air is circulated through the aerosol generator 15 and humidified and the resulting humidified air is expelled from an outlet 16 at the top of the aerosol generator 15.

Figure 2:
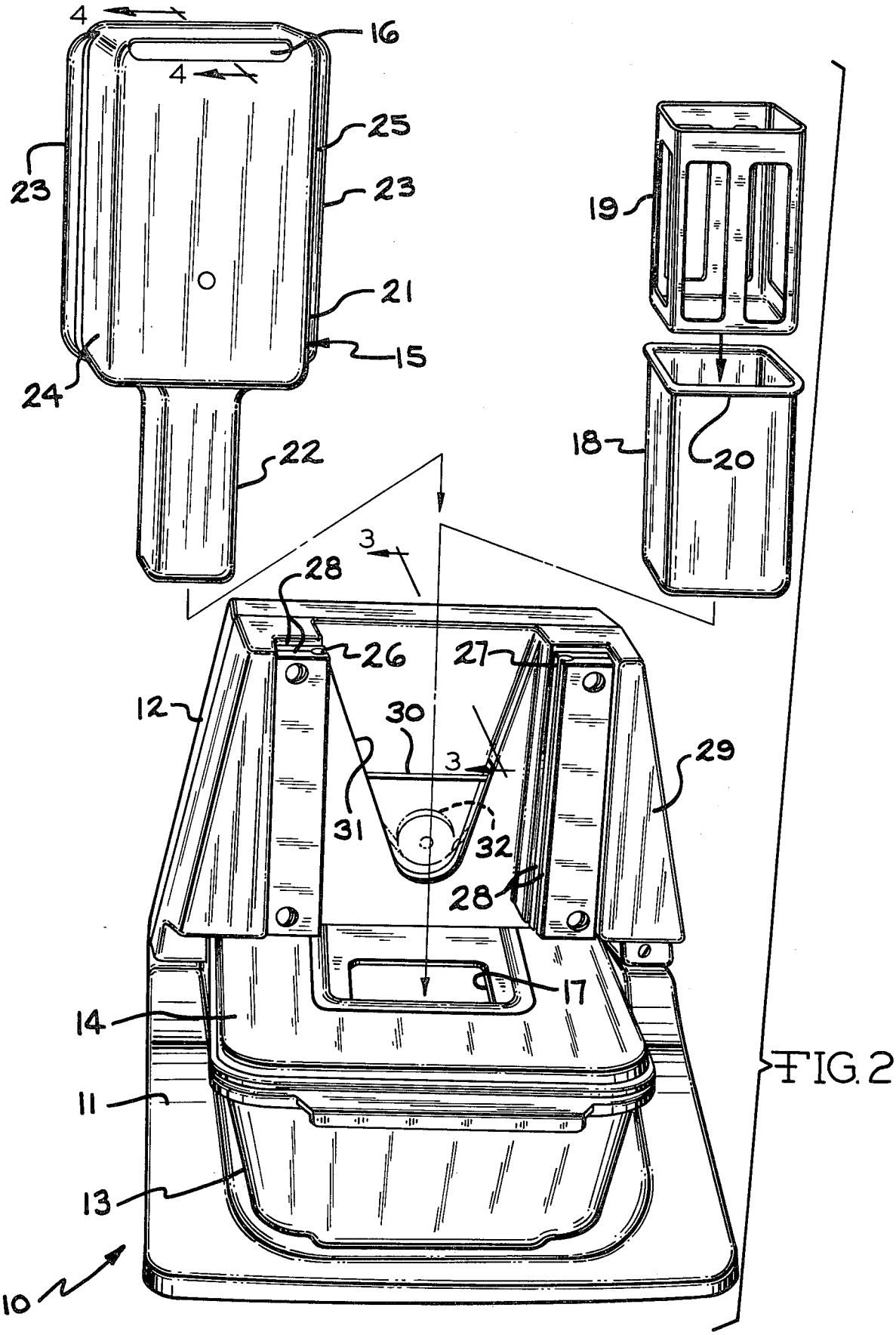
FIG. 2 is a front perspective exploded view of a humidifier constructed in accordance with the present invention.
Figure 3:
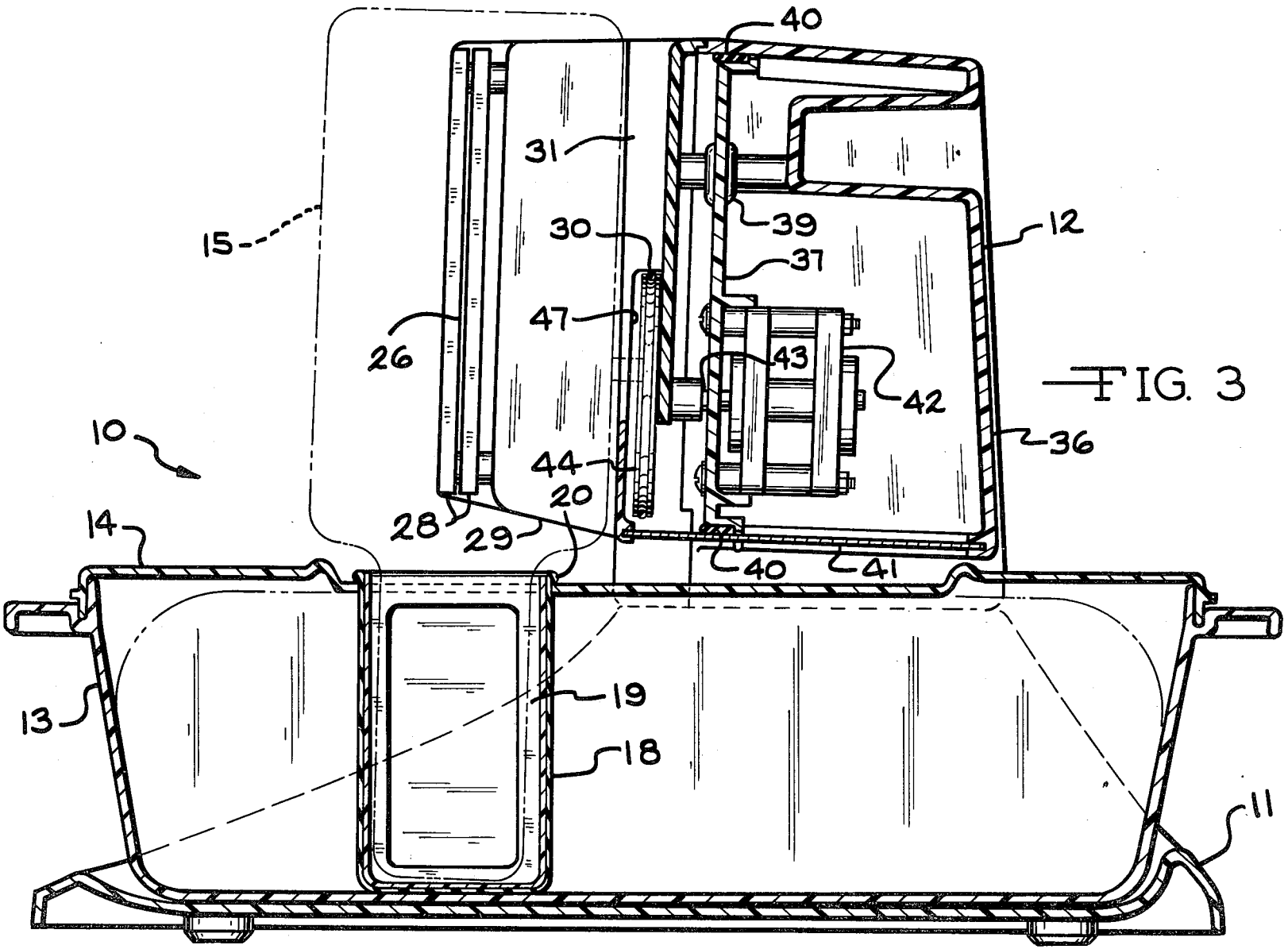
FIG. 3 is a vertical cross-sectional view of the humidifier taken along line 3—3 of FIG. 2.

Referring now to FIGS. 1–3, the general assembly of the humidifier 10 is illustrated. An opening 17 is provided in the reservoir lid 14. A disposable liner 18 is positioned over disposable plastic cage 19 and is inserted into the reservoir opening 17. An integral rib 20 extends around the upper periphery of the liner 18 for retaining the liner 18 at the lid opening 17. After the liner 18 and the cage 19 are positioned in the reservoir opening 17 the reservoir is filled with liquid through the opening 17. The liquid may be water or water and a medicament. As liquid is added to the reservoir, the liner 18 expands to substantially fill the interior of the reservoir base 13. As the liquid is consumed through atomization and vaporization, the liner 18 shrinks until it again contacts the cage 19 when all of the liquid is consumed. By using a disposable liner 18, the interior surfaces of the reservoir base 13 and the reservoir lid 14 will not become contaminated during use and, consequently, may be used repeatedly.

The aerosol generator 15 includes a housing having an upper section 21 which is positioned above the reservoir lid 14 and having a lower section 22 which extends downwardly through the reservoir lid opening 17 and abuts the bottom of the cage 19 and the reservoir base 13. Two parallel ribs 23 extend vertically along opposite sides 24 and 25 of the upper housing section 21. Two vertical grooves 26 and 28 are located on the motor housing 12 and are spaced apart for receiving the ribs 23 and 24. Preferrably the grooves 26 and 27 are each formed between a pair of members 28 which are resiliently attached to the motor housing 12 so as to permit alignment between the ribs 23 and the grooves 26 and 27. The aerosol generator 15 is attached to the motor housing 12 by positioning above the motor housing 12 and sliding vertically downwardly so that the ribs 23 slide into the grooves 26 and 27. As the generator 15 is moved downwardly, the lower housing section 22 moves downwardly through the reservoir lid opening 17. The motor housing 12 includes a front housing section 29 on which the members 28 are mounted. A portion of a belt 30 is exposed by a recess 31 in the front housing section 29. During operation of the humidifier 10, the belt 30 is advanced by a motor mounted within the motor housing 12, as is discussed in greater detail below. A sheave 32 on the back of the aerosol generator 15 engages and downwardly deflects the belt 30 as the aerosol generator 15 is attached to the front motor housing section 29. The belt 30 and the sheave 32 form a connection for driving the aerosol generator 15 from the motor mounted within the motor housing 12.

Figure 7:
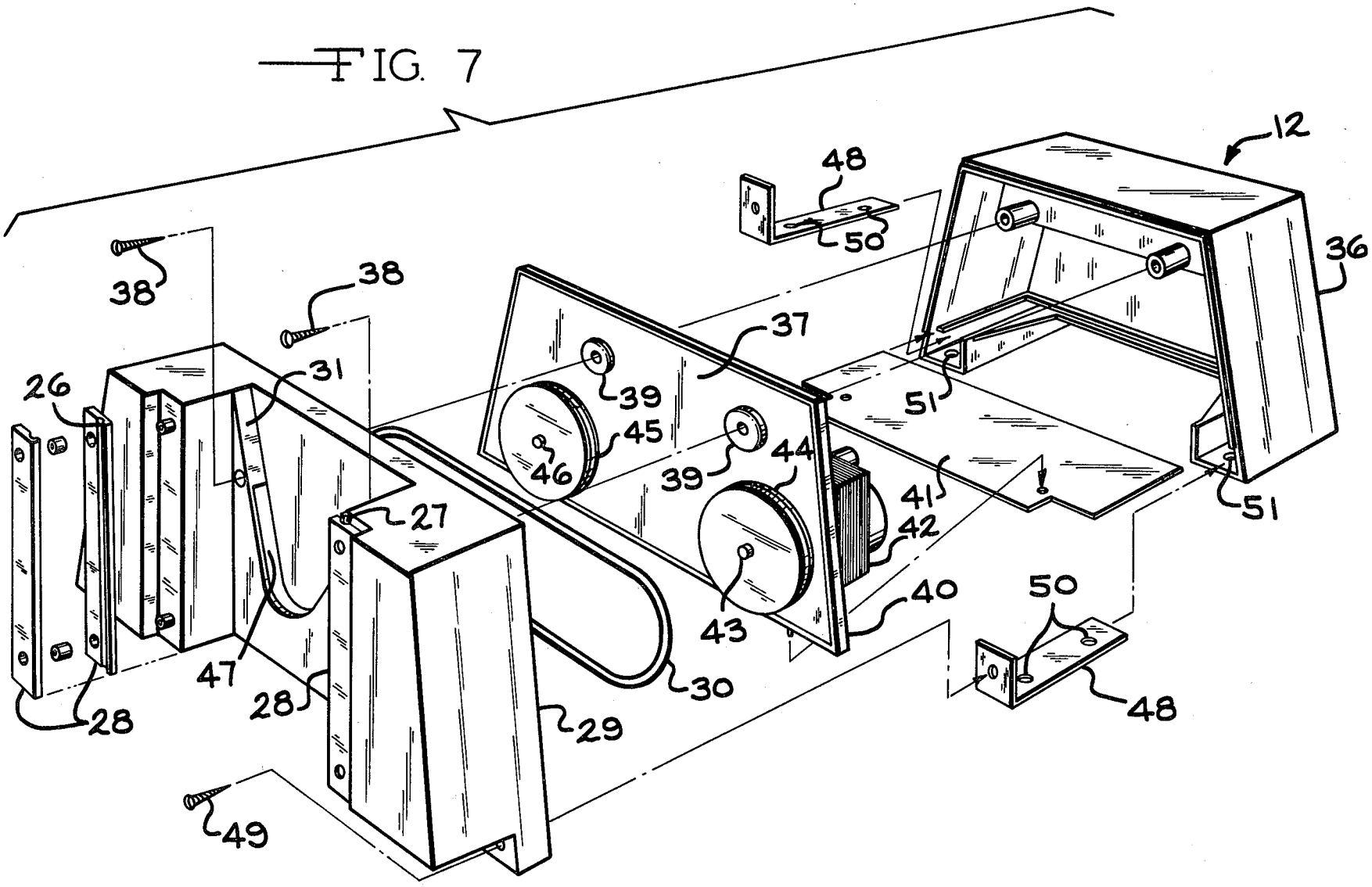
FIG. 7 is an exploded perspective view showing details of the motor and the motor housing for the humidifier of the present invention.

Turning now to FIGS. 2, 3 and 7, details are shown for the motor housing 12. The motor housing 12 includes the front section 29 and a rear housing section 36. A motor mounting plate 37 is positioned between the housing sections 29 and 36 and is held in place by fasteners 38 which extend between the housing sections 29 and 36 and through grommets 39 in the motor mounting plate 37. A rubber seal 40 extends around the periphery of the motor mounting plate 37 and closely engages the rear housing section 36 and a heat sink 41 which encloses the bottom of the rear housing section 36. A motor 42 is mounted on the back side of the motor mounting plate 37 and has a shaft 43 which extends through the motor mounting plate 37 and mounts a sheave or pulley 44. A second sheave or pulley 45 is mounted on a shaft 46 and the shaft is rotatably mounted on the motor mounting plate 37. The belt 30 extends over the two sheaves 44 and 45. The belt 30 may, for example, comprise an O-ring. The motor 42 is constructed to have a long operating life so that the humidifier 10 may be used in commercial applications, such as in hospitals. During operation of the motor 42, the seal 40 around the periphery of the motor mounting board 37 and the grommets 39 function to reduce noise transmission from the motor 42 to the housing 12. If desired, a fan (not shown) may be mounted on the back end of the motor shaft 43 for circulating air in the housing 12 to prevent overheating of the motor 42. When the housing 12 is assembled, a portion of the belt 30 extends through a slot 47 in the recessed portion 31 of the front housing section 29. Consequently, only this small section of the belt 30 is exposed and the sheaves 44 and 45 are enclosed within the front housing section 29.

The motor housing 12 is bolted to the base 11. Two brackets 48 are attached to the front housing section 29 with screws 49. The brackets 48 project into the rear housing section 36 and have holes 50 which align with holes 51 in the rear housing section 36. Bolts (not shown) are passed upwardly through the bottom of the base 11 through the holes 51 in the rear housing section 36 and through the bracket holes 50 for attaching the motor housing 12 to the base 11.

Figure 4:
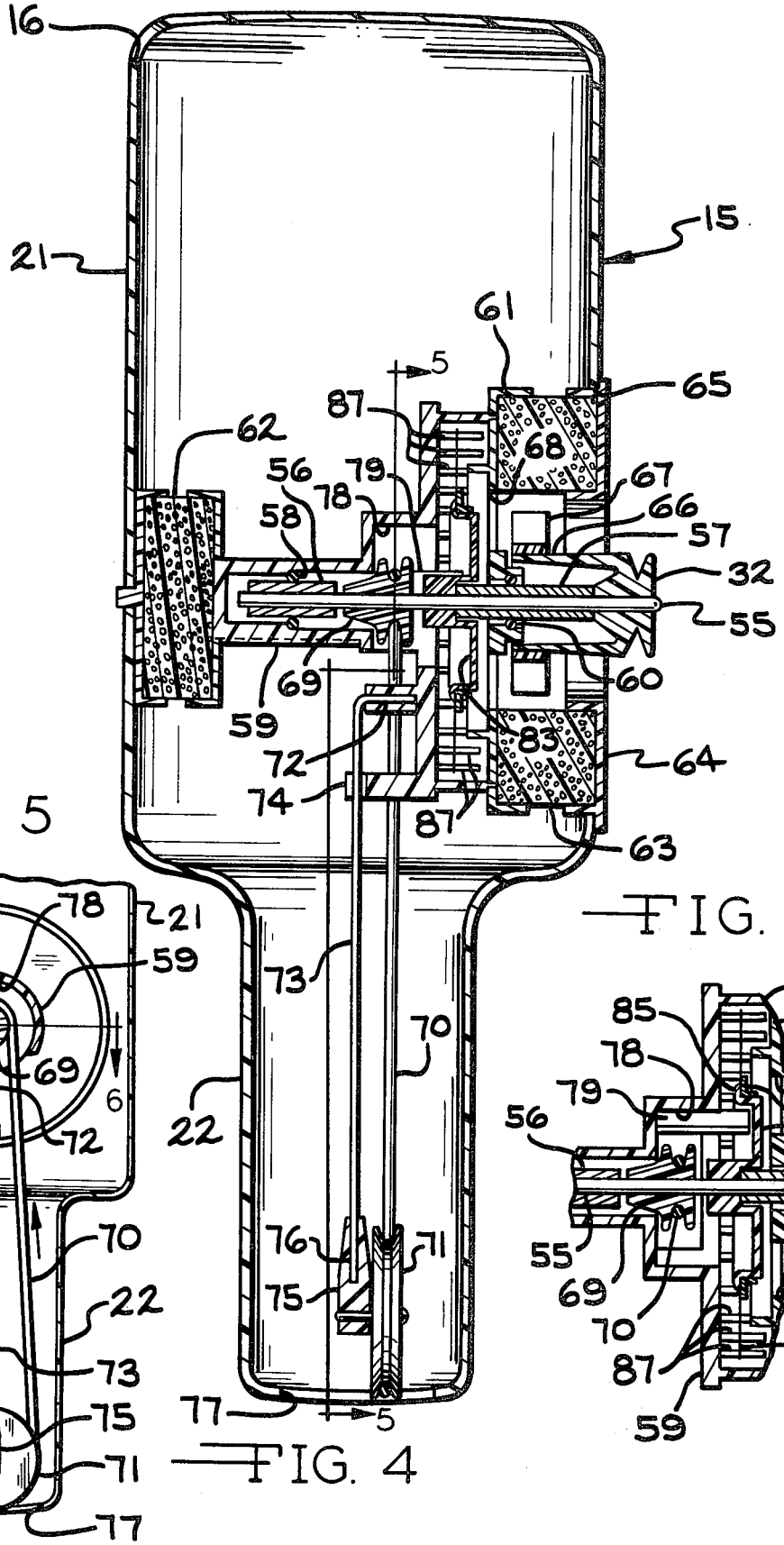
FIG. 4 is a vertical cross-sectional view of the aerosol generator taken along line 4—4 of FIG. 2.
Figure 5:
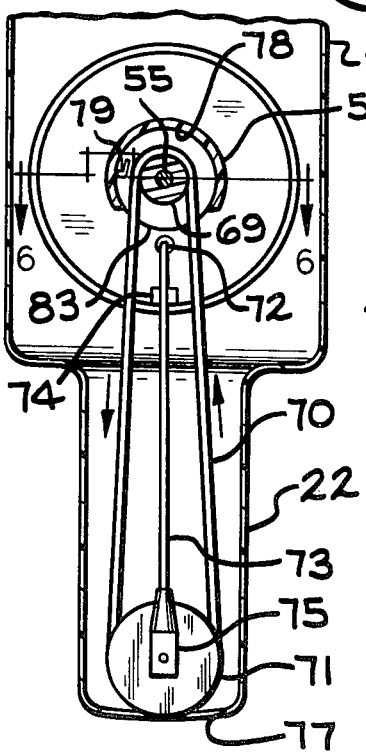
FIG. 5 is a fragmentary cross-sectional view taken along line 5—5 of FIG. 4.
Figure 6:
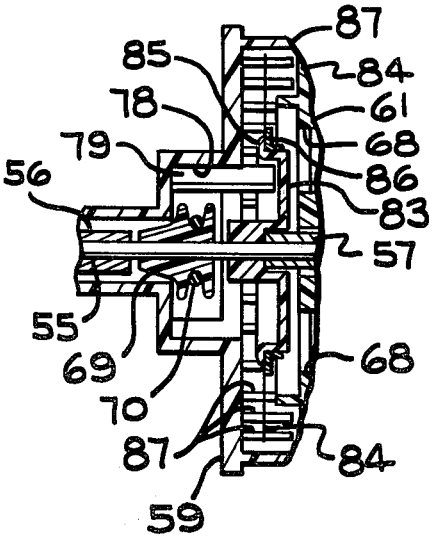
FIG. 6 is a fragmentary cross-sectional view taken along line 6—6 of FIG. 5.

Turning now to FIGS. 4–6, details are shown for the aerosol generator 15. The sheave 32 which engages the drive belt 30 on the motor housing 12 is mounted on a horizontal shaft 55. The drive belt 30 rotates the sheave 32 and the attached shaft 55 at a relatively high speed, for example, at as much as 13,000 RPM or more. The shaft 55 is rotatably supported by two bearings 56 and 57. The bearing 56 is connected through an O-ring 58 to a support housing 59 and the bearing 57 is connected through an O-ring 60 to a plate 61. The plate 61 and the support housing 59 are permanently connected together. The O-rings 58 and 60 permit movement of the bearings 56 and 57 relative to each other for alignment with the shaft 55 and also reduce vibration and noise transmission. Noise transmission is further reduced through the use of a resilient support 62 extending between the support housing 59 and the upper generator housing section 21 and a second resilient support 63 extending between the plate 61 and a plate 64 which is pressed into an opening 65 in the upper generator housing section 21. The resilient supports 62 and 63 may be formed from urethane foam, for example. The supports 62 and 63 not only stop noise transmission, but they also position the support housing 59 and the attached plate 61 within the upper generator housing section 21.

The sheave 32 includes fan blade 67. As the sheave 32 is rotated by the drive belt 30, the fan 67 is simultaneously rotated and draws air inwardly about the sheave 32, forces such air through openings 68 in the plate 61 and causes such air to flow though the upper generator housing 21 to the outlet 16. As the air flows through the upper housing section 21, it mixes with atomized liquid from the humidifier reservoir.

A sheave 69 is pressed onto the shaft 55 so as to rotate simultaneously with the shaft 55. A resilient belt 70, such as an O-ring, extends from the sheave 69 downwardly into the lower housing section 22 and over an idler wheel 71. An upper end 72 of a steel shaft 73 is pressed into the support housing 59 and extends downwardly through a retainer notch 74 in the support housing 59 and into the lower housing section 22. A bracket 75 is mounted on a lower end 76 of the shaft 73 for rotatably supporting the idler wheel 71 adjacent to the bottom of the lower housing section 22. During operation of the humidifier 10, the lower housing section 22 is submerged in the reservoir and liquid flows through a bottom opening 77 and into the lower housing section 22.

As the shaft 55 is rotated, the belt 70 advances. Through surface tension of the liquid within the reservoir, the side of the belt 70 moving upwardly lifts liquid from the reservoir to the sheave 69. As the belt 70 moves over the sheave 69, the liquid is thrown against an interior surface 78 of the support houing 59. This liquid is collected in a trough 79. Water received within the trough 79 flows to a hub 83 which is pressed onto and rotates with the shaft 55. A thin disk 84 is attached to the periphery 85 of the hub 83 by means of a ring 86. The disk 84 may be, for example, of Mylar. The liquid delivered by the trough 79 to the center region of the hub 83 flows outwardly away from the shaft 55 due to centrifugal force and flows over the hub periphery 85 and outwardly onto the disk 84. This liquid then is slung from the periphery of the disk 84 against a plurality of inpingement pins 87 which are fixed to the support housing 59. The disk atomizes the liquid that is slung from the disk into droplets. The pins break up the water droplets formed by the disk and further atomizes the liquid. In some applications the disk may produce enough atomized liquid that the pins are not necessary for the proper operation of the humidifier. This is especially true if the disk is caused to rotate at a sufficiently high speed. Therefore, it is possible to operate the humidifier without the pins 87. However, it has been found that the pins do assist in atomizing the liquid and the pins are normally used. The pins 87 are spaced from and around the periphery of the disk 84 for breaking up water droplets which impinge against such pins 87. The minute water droplets form an aerosol within the upper generator housing section 21. The air forced through the upper housing section 21 by the rotating fan blade 67 is quickly humidified. This humidified air along with the smallest water droplets is emitted from the outlet 16 from the aerosol generator 15. The larger water droplets within the upper housing section 21 are too heavy to be carried to the outlet 16 and fall back into the body of reservoir liquid within the lower housing section 22.

The individual components within the aerosol generator 15 are designed to be relatively inexpensive. Consequently, the entire aerosol generator 15 may be disposed of along with the reservoir liner 18. Since liquid and air circulated through the humidifier 10 contact only these components, the reuse of the humidifier 10 with a new aerosol generator 15, cage 19 and liner 18 does not present a health risk to subsequent patients using the humidifier 10. It should be appreciated that the cost of disposing of the aerosol generator 15, the cage 19 and the liner 18 is considerably reduced over disposing of an entire humidifier unit. Furthermore, minimum labor is required for replacing the disposable components, as compared to attempting to sterilize an entire humidifier.

Figure 8:
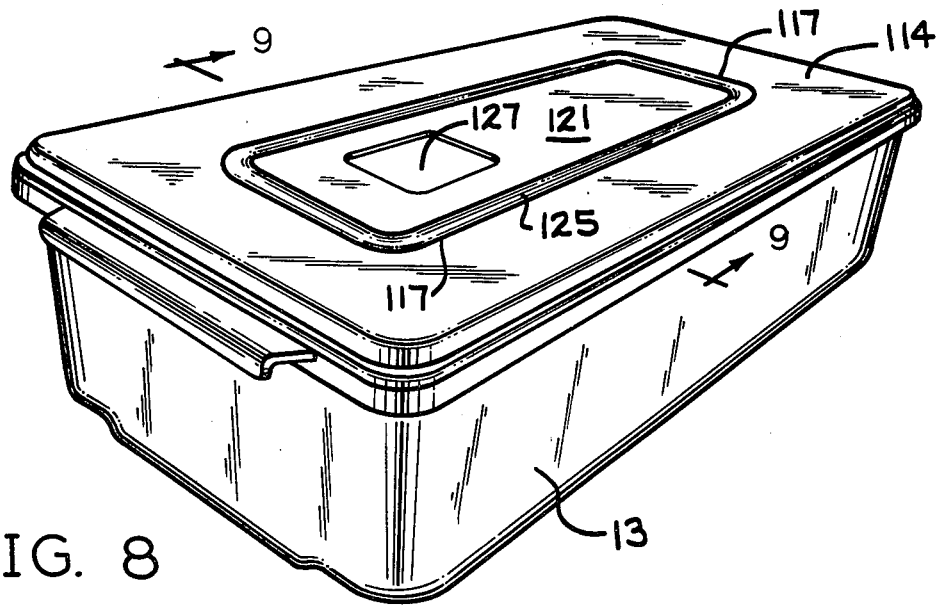
FIG. 8 is a perspective view of another embodiment of a removable liquid reservoir in accordance with the present invention.
Figure 9:
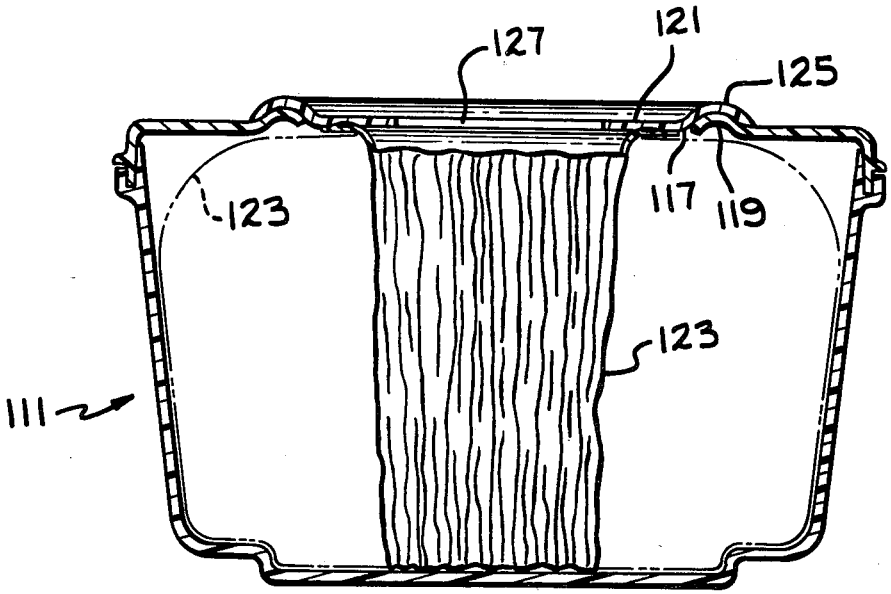
FIG. 9 is a cross-section view taken along line 9—9 of FIG. 8.

FIGS. 8 and 9 shown another embodiment for a disposable liner 111 that can be used with the present invention. The liner is constructed for positioning in reservoir base 13. The reservoir base has a lid 114 and the lid contains an elongated opening 117. A raised lip 119 is positioned on the lid 114 adjacent the outer periphery of the elongated opening 117. A plate 121 having an expandable container 123 is positioned on the lid 114. The plate 121 has a raised radiused section 125 that is positioned around the outer periphery of the plate. The raised radiused section 125 is positioned to matingly engage the raised lip 119 on the lid 114 to position the plate 121 on the lid 114.

The expandable container 123 is positioned to extend into the reservoir base 13 when the plate 121 is positioned on the lid 114. The plate 121 contains an opening 127 and the opening 127 is in communication with the interior of the expandable container 123. Normally the expandable container 123 is made from a flexible low-cost plastic material that is heat welded or sealed to the plate 121. The plastic material is folded or compacted in a manner that allows it to pass through the elongated opening 117 in the lid 114 when the plate 121 is positioned on the lid 114. The reservoir is filled with liquid through opening 127 in the plate 121. As the liquid passes through the opening 127 it is retained in the expandable container 123. As the quantity of liquid in the container 123 increases the container expands to accept the liquid. As can be seen by the broken lines in FIG. 9 the container 123 can expand to substantially fill the interior cavity of the reservoir base 13 if a sufficient quantity of liquid is supplied to the expandable container. The aerosol generator 15 is positioned in the opening 127 located in the plate 121. Once the disposable liner 111 is positioned in the humidifier, the humidifier operates in substantially the manner previously described.

When it is time to sterilizer the humidifier the plate 121 and expandable container 123 can be removed from the reservoir base 13 and discarded. Since the liquid is retained within the expandable container 123 and does not come into contact with the reservoir base 13 or lid 114 it is usually not necessary to clean or sterilize the reservoir base or lid. This embodiment of a disposable liner is inexpensive, easily replaced and facilitates the sterilization and cleaning of the humidifier.

Figure 10:
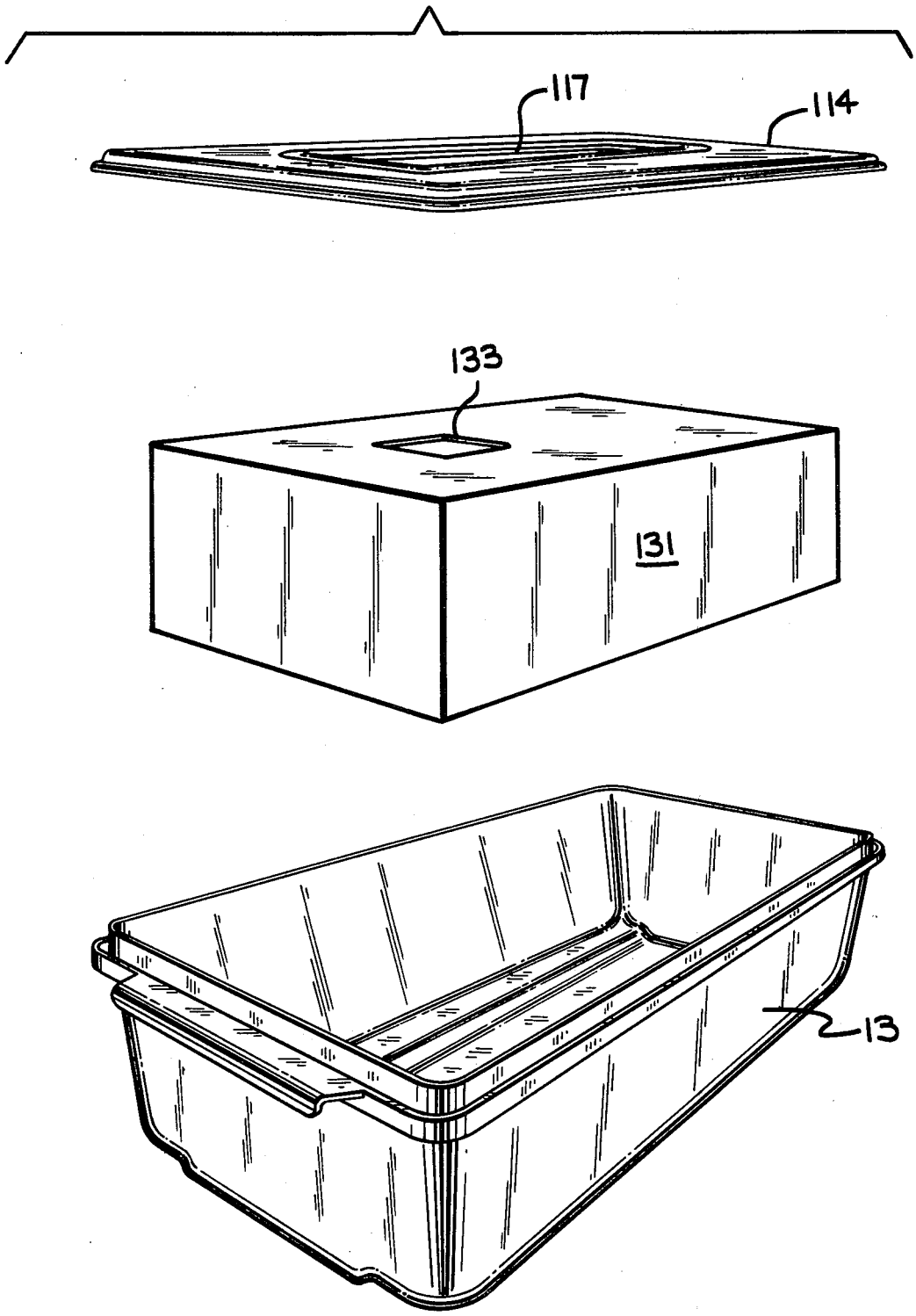
FIG. 10 is a front perspective exploded view of another embodiment of a removable liquid reservoir in accordance with the present invention.

FIG. 10 shows another embodiment of a disposable liner 131 that can be used with the present invention. The liner 131 is an enclosed container that is designed to fit within the reservoir base 13. The disposable liner 131 is constructed to substantially fill the volume of the reservoir base. The top of the disposable liner contains an opening 133. After the disposable liner is positioned in the reservoir base the lid 114 is positioned on the reservoir base. The opening 133 is the disposable liner 131 is positioned to be in alignment with the elongated opening 117 in the lid 114. The disposable liner 131 is constructed of a light weight, thin walled and inexpensive material such as plastic or a coated paper such as used in the construction of milk cartons.

The liquid for the humidifier is positioned in the disposable liner 131 through the opening 133. The disposable liner retains the liquid and prevents it from coming into contact with the reservoir base 13 or the lid 114. The disposable liner 131 can be discarded when the humidifier is cleaned and sterilized. The operation of the humidifier with the disposable liner 131 is substantially the same as previously described.

Figure 11:
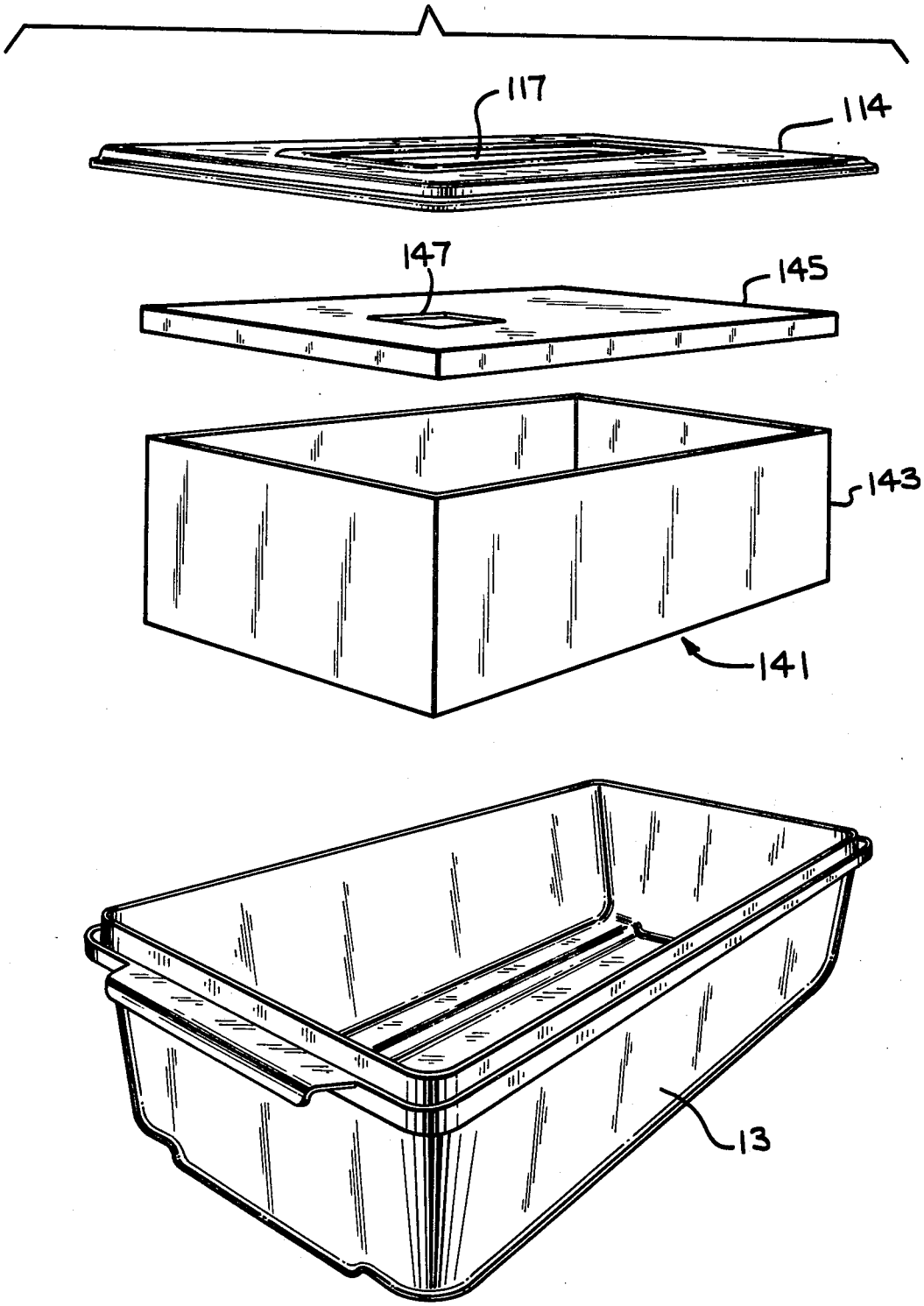
FIG. 11 is a front perspective exploded view of another embodiment of a removable liquid reservoir in accordance with the present invention.

FIG. 11 shows another embodiment of a disposable liner 141 that can be used with the present invention. The disposable liner 141 includes a base portion 143 for containing liquid. The base portion is constructed to fit into the reservoir base 13 and substantially fill the volume of the reservoir base. The disposable liner 141 also includes a lid 145 that is positioned on top of the base portion 143 to form an enclosed container. The lid 145 contains an opening 147. The disposable liner 141 is constructed of the same material as the previously discussed disposable liner 131.

The base portion 143 of the disposable liner 141 is positioned in the reservoir base 13 and then the lid 145 is positioned on the base portion 143. The base portion 143 and lid 145 form an enclosed container within the reservoir base 13. The lid 114 is then positioned on the reservoir base 13. The opening 147 in the lid 145 is in alignment with the elongated opening 117 in the lid 114. The disposable liner 141 is filled with liquid through the opening 147. In addition, the opening 147 is designed to accept the aerosol generator 15. The operation of the humidifier with the disposable liner 141 is substantially the same as previously described.

After use the base portion 143 of the lid 145 of the disposable liner 141 are removed from the reservoir base 13 and disposed of in lieu of sterilization. As the disposable liner 141 forms an enclosed container the liquid does not contact the reservoir base 13 or the lid 114 and it is usually not necessary to clean or sterilize these components. The disposable liner 141 is constructed of a light weight and inexpensive material and this portion of the humidifier can easily be disposed of and replaced without incurring a great deal of expense. Furthermore, the construction of the disposable liner 141 allows the liner to be replaced very quickly to greatly facilitate the sterilization of the humidifier unit.

It will be appreciated that various changes and modifications may be made in the above described humidifier without departing from the spirit and the scope of the following claims.

What I claim is:

1. A humidifier comprising a first housing, reservoir means for holding a body of liquid, a second housing, means for removably attaching said second housing to said first housing, first and second sheaves positioned in said second housing, said first sheave being positioned in said reservoir below the normal liquid surface level and said second sheave being positioned above such liquid surface level when said second housing is attached to said first housing, motor means positioned in said first housing for rotaing said second sheave whereby said endless belt advances from said first sheave to said second sheave to convey liquid from said reservoir means to said second sheave, disengageable means driveably connecting said second sheave to said motor means when said second housing is attached to said first housing, means for receiving such liquid conveyed to said second sheave, and means for atomizing such received liquid positioned in said second housing.

2. A humidifier, as set forth in claim 1, wherein said motor means includes two spaced rotatable pulleys, a motor connected to drive one of said two spaced pulleys and a second belt extending over said two spaced pulleys, and wherein said disengagable means includes a third sheave drivably connected to said second sheave and means rotatably mounting said third sheave on said second housing for frictionally engaging said second belt when said second housing is attached to said first housing.

3. A humidifier, as set forth in claim 1 or 2, wherein said atomizing means includes a disc having a center hub region and a periphery, means for rotating said disc about an axis, a plurality of impingement pins extending parallel to said axis and spaced from and around said disc periphery, and wherein said liquid receiving means includes means for delivering such received liquid to said disc hub region whereby such delivered liquid is thrown centrifugally from said disc periphery against said pins and atomized.

4. A humidifier, as set forth in claim 1, and wherein said reservoir means includes a container and a disposable liner lining said container, said liner holding such body of liquid.

5. A humidifier comprising reservoir means for holding a body of liquid, an enclosed first housing, a motor mounted within said first housing, a second housing, means releasably attaching said second housing to said first housing, said second housing projecting downwardly into such body of liquid in said reservoir means when said second housing is attached to said first housing, an aerosol generator mounted in said second housing and including means for generating an aerosol from reservoir liquid and means for circulating air from outside said second housing through said second housing in contact with such aerosol, and means for driving said aerosol generating means from said motor when said second housing is attached to said first housing.

6. A humidifier, as set forth in claim 5, and wherein said reservoir means includes a container and a disposable liner lining said container, said liner holding such body of liquid.

7. A humidifier, as set forth in claim 6, wherein said means for generating said aerosol includes first and second sheaves, means for mounting said first sheave in said second housing below the normal reservoir liquid surface level when said second housing is attached to said first housing, means for mounting said second sheave in said second housing above such liquid surface level, an endless belt extending over said first and second sheaves, means responsive to said driving means for rotating said second sheave whereby said endless belt advances from said first sheave to said second sheave to convey liquid from said reservoir means to said second sheave means for receiving such liquid conveyed to said second sheave, and means for atomizing such received liquid.

8. The humidifier, as set forth in claim 6, wherein said disposable liner is an expandable liner positioned in said reservoir.

9. The humidifier, as set forth in claim 6, wherein said reservoir contains an opening on one side for receiving said liquid.

10. The humidifier, as set forth in claim 9, wherein a plate having an opening is positioned on said side of said reservoir containing an opening, said opening in said plate being in alignment with said opening in said reservoir, said plate includes a liner positioned on one side thereof, said liner being disposed to extend through said opening in said reservoir, said opening in said plate being in communication with the interior of said liner.

11. The humidifier as set forth in claim 10, wherein said reservoir contains a raised lip around the periphery of said opening in said reservoir, said plate containing a raised radiused section, said raised radiused section disposed to engage said raised lip on said reservoir whereby said plate is maintained in position on said reservoir.

12. The humidifier, as set forth in claim 10, wherein said liner is heat sealed to said plate to form a water tight connection between said liner and said plate.

13. The humidifier, as set forth in claim 9, wherein said liner is a disposable container positioned in said reservoir, said container having an opening on one side thereof, said opening in said container being in alignment with said opening in said reservoir.

* * * * *